US007788767B2

(12) United States Patent
Chen

(10) Patent No.: US 7,788,767 B2
(45) Date of Patent: Sep. 7, 2010

(54) AUTOMATIC DOOR SHUTTER

(76) Inventor: Chun-Ju Chen, No. 73-1, Lunwei, Meibei Village, Sikou Township, Chiayi County 623 (TW)

( * ) Notice: Subject to any disclaimer, the term of this patent is extended or adjusted under 35 U.S.C. 154(b) by 421 days.

(21) Appl. No.: 11/934,813

(22) Filed: Nov. 5, 2007

(65) Prior Publication Data

US 2009/0113668 A1 May 7, 2009

(51) Int. Cl.
*E05F 1/10* (2006.01)

(52) U.S. Cl. ..... 16/73; 16/72; 16/50; 16/286; 16/80; 16/285

(58) Field of Classification Search ..... 16/771, 16/72, 73, 75, 85, 50, 54, 286, 374, 285; 49/386; 292/297, 298
See application file for complete search history.

(56) References Cited

U.S. PATENT DOCUMENTS

| | | | | | |
|---|---|---|---|---|---|
| 724,039 | A | * | 3/1903 | Peterkin | 16/285 |
| 1,652,643 | A | * | 12/1927 | Sherwood | 16/80 |
| 2,011,694 | A | * | 8/1935 | Herbert | 16/73 |
| 2,199,628 | A | * | 5/1940 | Gallinger | 16/76 |
| 2,290,219 | A | * | 7/1942 | Ulfving | 16/291 |
| 2,394,878 | A | * | 2/1946 | Slopa | 292/79 |
| 2,651,074 | A | * | 9/1953 | Slopa et al. | 16/80 |
| 3,344,462 | A | * | 10/1967 | Webster | 16/357 |
| 3,518,715 | A | * | 7/1970 | Weiner | 16/80 |
| 4,196,924 | A | * | 4/1980 | Iseki | 292/79 |
| 4,322,100 | A | * | 3/1982 | McLennan et al. | 292/67 |
| 5,272,789 | A | * | 12/1993 | Mitchell et al. | 16/291 |
| 5,539,954 | A | * | 7/1996 | Ambar | 16/85 |

* cited by examiner

*Primary Examiner*—Chuck Y. Mah
(74) *Attorney, Agent, or Firm*—Alan Kamrath; Kamrath & Associates PA

(57) ABSTRACT

An automatic door shutter includes a stationary plate and a pressing plate pivotally combined together and with a resilient body located therebetween. Additionally, a pivot of the stationary plate has a sliding notch accepting an S-shaped resilient sheet abutting the pressing plate. By attaching the stationary plate and the sliding base to a door frame and a door respectively, the resilient body pushes the pressing plate to shut the door automatically. When the door is pushing to fully open, the pressing plate pivots to the stationary plate, and the S-shaped resilient sheet slides in the sliding recess and is compressed to deform to become U-shape. Until the door is fully open, the resilient sheet which is U-shaped causes an outward pushing force to the pressing plate to keep the door open constantly.

2 Claims, 4 Drawing Sheets

AUTOMATIC DOOR SHUTTER

BACKGROUND OF THE INVENTION

1. Field of the Invention

The present invention relates to a door shutter and, more particularly, to a door shutter to close a door automatically or to selectively locate the door to be open.

2. Description of Related Art

In most occasions, keeping a door closed is polite and also a safety concern. However, most people do not have this habit. Usually the door is open or swings in the wind. As leaving a door open not only raises home break-in concerns by an evildoer but also reduces the efficiency of an indoor air conditioning, manufacturers have developed many automatic hinges to resolve those problems. The automatic hinges drive the door to shut automatically after the door is open so that the door can be kept closed always and conveniently without paying attention by the users.

However, the conventional automatic hinge is attached between a door frame and a door and, thus, has to be prepared before the door is mounted to the frame so that the conventional automatic hinge can be built according to the structures of the door frame and door. Unfortunately, most present door assemblies are plain designs in door structure (i.e. only equipped with simple hinges) and do not have the automatic shutting efficiency. Therefore, the conventional automatic hinges can not be directly applied to the door assemblies (relative locations and distance between the door and the door frame are all factors to check whether the automatic hinges can be attached or not). When users apply the conventional automatic hinges to the door assemblies, the door must be detached, modified and reformed according to the door frame and the automatic hinges. Therefore, the attaching process of the conventional automatic hinge is complex and can not be accepted and performed by common users. The conventional automatic hinge is not widely utilized in households.

Other conventional automatic door shutters usually have pneumatic cylinders or hydraulic cylinders that greatly increase the cost and volume. Therefore, the conventional automatic door shutters are not accepted by general consumers and only limited to use in commercial sites or market buildings.

SUMMARY OF THE INVENTION

A main objective of the present invention is to provide an automatic door shutter that is convenient to apply to an assembled door assembly.

Another main objective of the present invention is to provide an automatic door shutter that selectively keeps the door open stably or closes the door automatically.

To achieve the foregoing objectives, the automatic door shutter comprises:

a stationary plate adapted to mount on a door frame and having a pivotal shaft with an outer end and a sliding notch defined at the outer end;

a sliding base adapted to mount on a door beard;

a pressing plate engaging the sliding base and adapted to mount on the door, with the pressing plate pivotally attaching the stationary plate and having a front end with a sliding recess to slidably combine with the sliding base;

a resilient body attached between the stationary plate and the pressing plate for resilient restitution; and an S-shaped resilient sheet having one end received inside the sliding notch of the stationary plate and another end abutting the pressing plate;

wherein the resilient body deforms to provide a restitution force to shut the door automatically after the door is pushed, wherein the S-shaped resilient sheet is deformed to become U-shaped to push the pressing plate when the door is fully open.

Further benefits and advantages of the present invention will become apparent after a careful reading of the detailed description with appropriate reference to the accompanying drawings.

DETAILED DESCRIPTION OF THE PREFERRED EMBODIMENT

An automatic door shutter in accordance with the present invention comprises a stationary plate and a pressing plate pivotally combined together and with a resilient body located therebetween for resilient restitution. Additionally, a pivot of the stationary plate has a sliding notch defined on its outer periphery to accept a resilient sheet also abutting an inner side of the pressing plate. The pressing plate has a front end and a sliding recess defined at the front end to slidably combine with a sliding base. By attaching the stationary plate and the sliding base to a door frame and a door respectively, the resilient body reactively pushes the pressing plate to shut the door automatically. When the door is pushed to fully open, the pressing plate pivots relative to the stationary plate, and, then, the resilient sheet slides in the sliding recess and is compressed to deform to be U-shaped. Until the door is fully open, the resilient sheet causes an outward pushing force to push the pressing plate to keep the door open.

Figure 1:
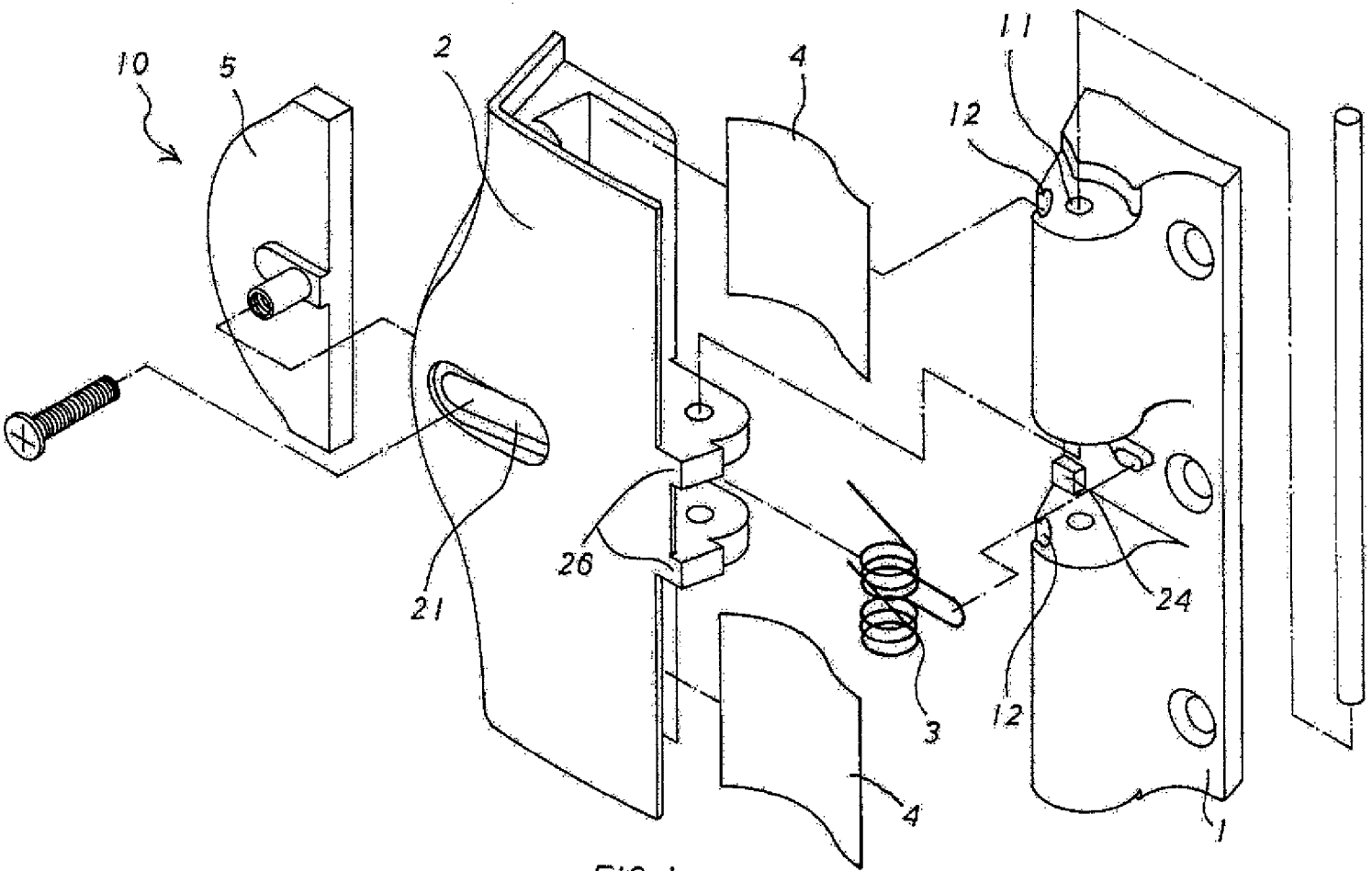
FIG. 1 is an exploded perspective view of an automatic door shutter in accordance with the present invention.
Figure 2:
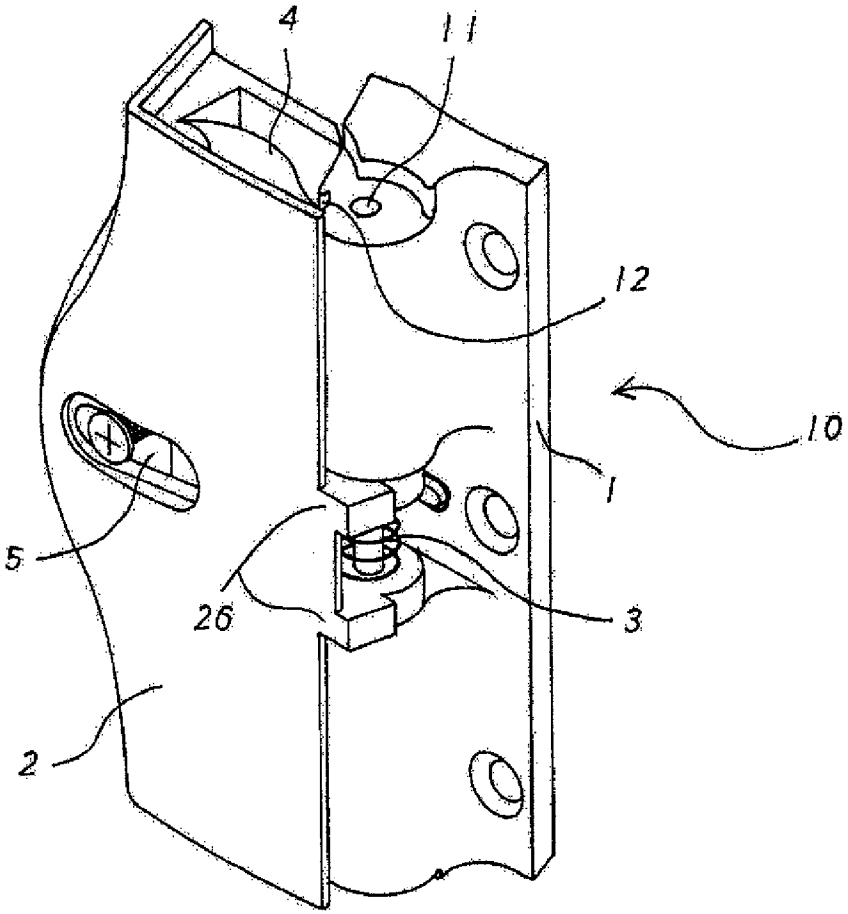
FIG. 2 is a perspective view of the automatic door shutter in FIG. 1, wherein the automatic door shutter is assembled.

A preferred embodiment of the automatic door shutter 10 is composed of a stationary plate 1 and a pressing plate 2 pivotally engaged together (as shown in FIG. 1) and to arrange a resilient body 3 (i.e. a spring) therebetween to keep a reactive angle range for resilient restitution. The resilient body 3 in the form of, spring sleeves between the stationary plate 1 and the pressing plate 2 coaxially. The stationary plate 1 has a pivotal shaft 11 and a sliding notch 12 defined on an outer periphery of the pivotal shaft 11 to receive one end of an S-shaped resilient sheet 4 that also abuts an inner side of the pressing plate 2. Moreover, the pressing plate 2 has a front end and a sliding recess 21 defined at the front end to allow a bolt passing therethrough to combine slidably with a sliding base 5 to achieve the automatic door shutter in the present invention (as shown in FIG. 2).

Figure 3:
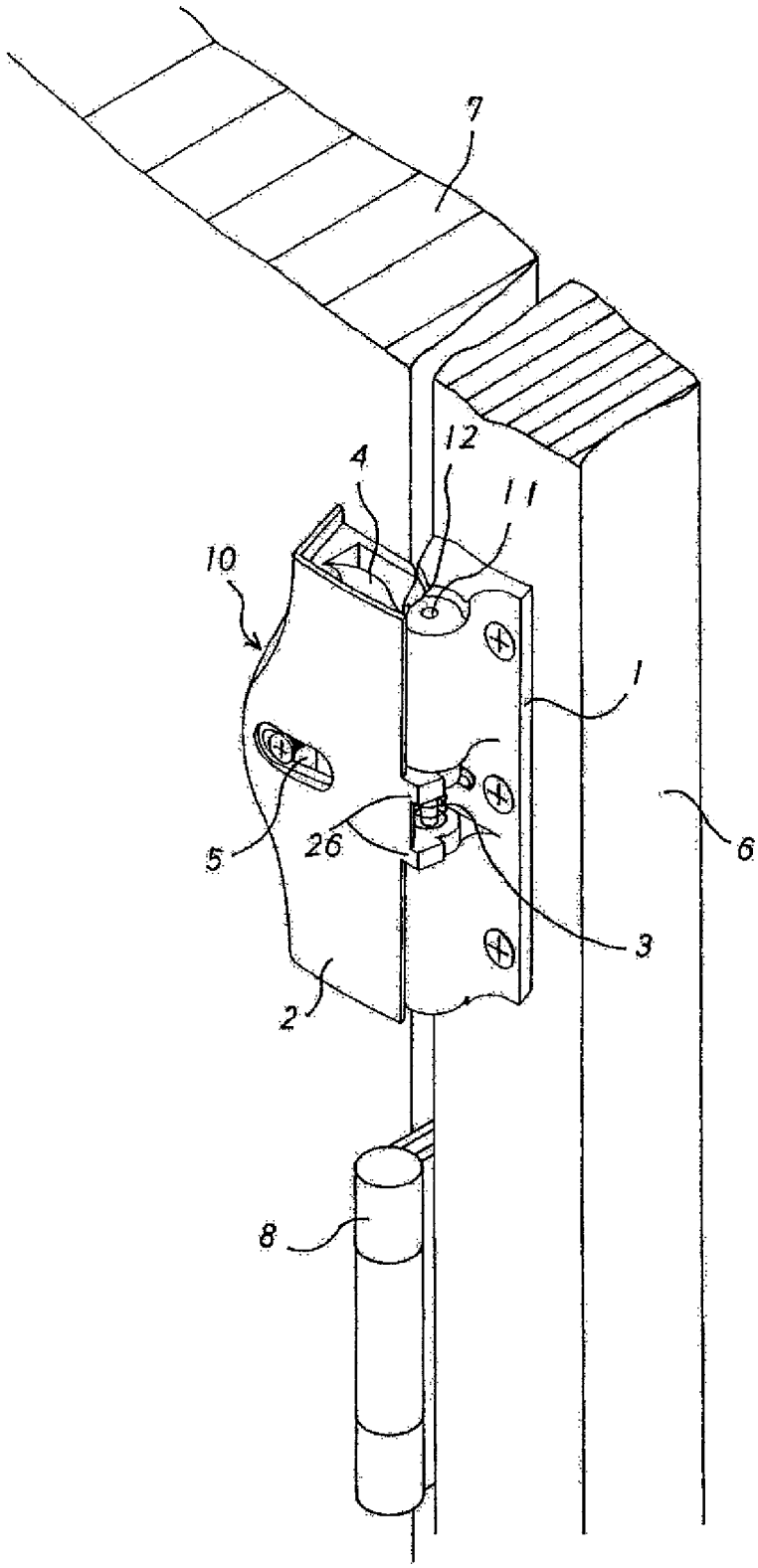
FIG. 3 is a perspective view of the automatic door shutter mounted to a door assembly.

By having the foregoing elements, the stationary plate 1 is attached to a door frame 6 (as shown in FIG. 3), and the sliding base 5 is mounted on the door 7. Thus, the resilient body 3 provides a resilient force to push the pressing plate 2 and to then push the sliding base 5 to keep the door 7 closed constantly. When a user opens the door, a hinge 8 of the door 7 has a pivotal center differing from one of the pivotal shaft 11 of the automatic door shutter 10 so that a location bias of the door 7 caused by rotation can be eliminated by the relative displacement of the sliding base 5 and the pressing plate 2.

Therefore, the door 7 has a smooth movement without obstruction. When the door is opened, the rotation of the pressing plate 2 deforms the resilient body 3 to generate more resilient deformation so that the restitution force provided by the resilient body 3 pushes the door 7 to shut automatically when the door 7 is released. Thus, the automatic shutting performance is achieved.

The S-shaped resilient sheet 4 has a fixed end attached to the pressing plate 2 and a movable end received inside the sliding notch 12 so as to be clamped between the stationary plate 1 and the pressing plate 2. Therefore, the S-shaped resilient sheet 4 is at a position bias to the pivotal shaft 11 of the stationary plate 1 and the pressing plate 2 and thus is driven to deform to a U-shape when the pressing plate 2 rotates. According to FIG. 4, the U-shaped resilient sheet provides a pushing force to push the pressing plate 2. Particularly, the pushing force provided by the S-shaped resilient sheet 4 is larger than the restitution force provided by the resilient body 3 to keep the door open by the restitution force.

Figure 4:
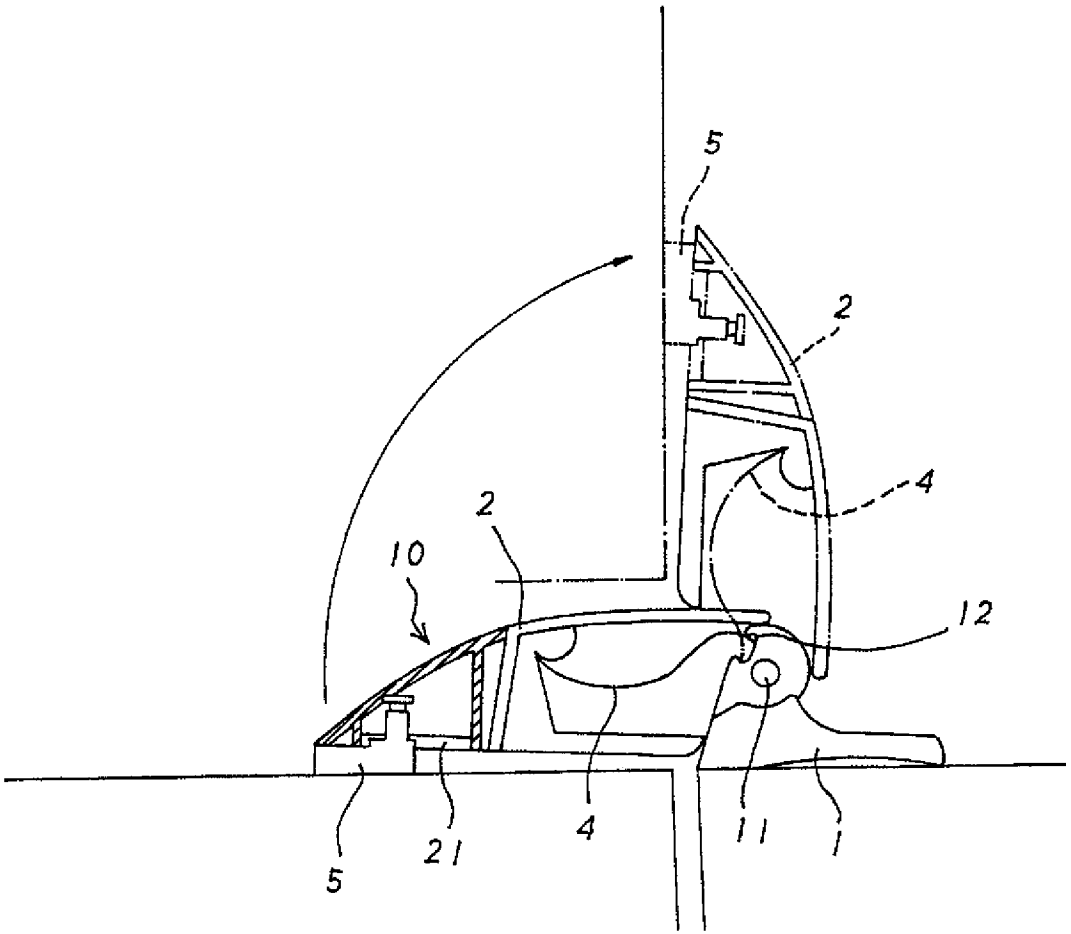
FIG. 4 is an operational cross-sectional view of the automatic door shutter cooperating with the door assembly as shown in FIG. 3.

When the user wants to keep the door open, the pressing plate 2 is pushed toward the stationary plate 1. The fixed end on the S-shaped resilient sheet 4 is pulled in an arc line by the pressing plate 2, and the movable end of the S-shaped resilient sheet 4 slides in the sliding notch 12 until the S-shaped resilient sheet 4 turns into a U-shape that keeps a propping force to the pressing plate 2 (with the door 7) to keep the door open. Until the door is fully open, the S-shaped resilient sheet 4 deformed to a U-shape provides a force to push the pressing plate 2 outward. As shown in FIG. 4, the S-shaped resilient sheet 4 is substantially U-shaped and fixed in an angle by a positioning structure at a pivotal combination structure of the co-axle (i.e. the pivotal shaft 11) of the stationary plate 1 and the pressing plate 2. The position structure includes two blocks 24 and 26 respectively formed on the stationary plate 1 and the pressing plate 2. Because the resilient sheet 4 in a U-shape has a resilient force (the pushing force) larger than the restitution force of the resilient body 3, the door 7 can be kept fully open. On the contrary, when the resilient sheet 4 is reinstated from the U-shaped deformation by slightly pushing the door 7 to overcome a limit angle (exceeding the reactive angle range), the restitution force of the resilient body 3 drives the pressing plate 2 to shut the door 7 automatically once again.

According to the above description, the automatic door shutter in the present invention has the following advantages:

1. Because the stationary plate 1 and the sliding base 2 are respectively combined to the door frame 6 and the door 7, the resilient body 3 provides a restitution force and then presses the pressing plate 2 on the door 7 correspondingly connected by the sliding base 5 to shut the door 7 automatically.

2. In the process to fully open the door, the S-shaped resilient sheet 4 slides in the sliding notch 12 and is compressed to deform into a U-shape along with the rotation of the pressing plate 2, because the sliding notch 12 closes relative to the pressing plate 2. Then, the S-shape resilient sheet 4 is bent and generates a force pushing the pressing plate 2 outward (meanwhile, the S-shaped resilient sheet 4 is substantially U-shaped) to keep the door fully open. When the user pulls the door to close, the S-shaped resilient sheet 4 is reinstated from the deformation by slightly pushing the door 7 to overcome the limit angle to eliminate the outward pushing force. Thus, the restitution force of the resilient body 3 drives the pressing plate 2 to shut the door 7 automatically once again.

3. Because the stationary plate 1 and the pressing plate 2 can be attached to the door without disassembling the door frame 6 and the door 7, applying the automatic door shutter 10 is simple and convenient to increase utility efficiency to households. Moreover, components of the automatic door shutter 10 are simple and low-cost so that the automatic door shutter 10 in the present invention is popular and economically available.

Although this invention has been described in its preferred form with a certain degree of particularity, it is understood that the present invention of the preferred form has been made only by way of example and that numerous is changes in the details of construction and the combination and arrangement of parts any be resorted to without departing from the spirit and scope of the invention.

What is claimed is:

1. An automatic door shutter comprising:

a stationary plate adapted to mount on a door frame, with the stationary plate having a pivotal shaft with an outer periphery, with a sliding notch defined at the outer periphery;

a sliding base adapted to mount on a door;

a pressing plate engaging the sliding base, with the pressing plate pivotally attached to the stationary plate for movement between an open position and a closed position, and with the pressing plate having a front end with a sliding recess to slidably combine with the sliding base;

a resilient body attached between the stationary plate and the pressing plate for resilient restitution therebetween; and a resilient sheet having one end received inside the sliding notch of the stationary plate and another end abutting the pressing plate;

wherein the resilient body deforms to provide a restitution force when the pressing plate pivots from the closed position to the open position to shut the door automatically after the door is pushed, with the resilient sheet being S-shaped when the pressing plate is in the closed position and is deformed to a U-shape when the pressing plate is in the open position to push the pressing plate towards the closed position.

2. The automatic door shutter as claimed in claim 1, further comprising: blocks respectively formed on the pressing plate and the stationary plate to keep the door from over rotation.

* * * * *